US006004008A

United States Patent [19]

Lai

[11] Patent Number: 6,004,008

[45] Date of Patent: Dec. 21, 1999

[54] MULTI-FUNCTIONAL FLASHLIGHT

[75] Inventor: Larry Lai, Chia-Yi Hsien, Taiwan

[73] Assignee: Plum Industrial Co., Ltd., Taiwan

[21] Appl. No.: 09/048,173

[22] Filed: Mar. 26, 1998

[51] Int. Cl.[6] ..... F21L 7/00

[52] U.S. Cl. ..... 362/280; 362/188; 362/202; 362/323

[58] Field of Search ..... 362/187, 188, 362/202, 277, 280, 319, 323

[56] References Cited

U.S. PATENT DOCUMENTS

| | | | |
|---|---|---|---|
| 2,777,121 | 1/1957 | Schön | 362/202 X |
| 4,530,039 | 7/1985 | Shin-Shi | 362/187 X |
| 4,609,976 | 9/1986 | Geissler | 362/188 X |
| 4,899,265 | 2/1990 | Maglica | 362/187 |
| 4,984,141 | 1/1991 | Lai | 362/187 |
| 5,001,612 | 3/1991 | Odlum | 362/187 |
| 5,031,080 | 7/1991 | Aikens et al. | 362/62 |
| 5,560,705 | 10/1996 | Shiau | 362/188 |
| 5,588,739 | 12/1996 | Nakao | 362/277 X |
| 5,735,594 | 4/1998 | Own | 362/188 X |

*Primary Examiner*—Laura K. Tso
*Attorney, Agent, or Firm*—Larson & Taylor

[57] ABSTRACT

A flashlight includes a barrel for receiving a battery unit therein, a bulb mounted in the barrel, a transparent housing threadedly engaged with a front end of the barrel, a reflective mirror mounted in the housing to move therewith, and a rear cap mounted to seal a rear end of the barrel. An outer casing is threadedly engaged around the housing such that rotational movement of the housing causes movements of the housing and the reflective mirror relative to the bulb to thereby place the bulb in a position either surrounded or not surrounded by the reflective mirror. A colored sleeve is removably mounted between the bulb and the housing.

4 Claims, 3 Drawing Sheets

MULTI-FUNCTIONAL FLASHLIGHT

BACKGROUND OF THE INVENTION

1. Field of the Invention

The present invention relates to a multi-functional flashlight and, more particularly, to an improved flashlight which can be used for illumination and hazard indication and can be used as a desk lamp, lantern, or night-light.

2. Description of the Related Art

U.S. Pat. No. 4,984,141 to Lai et. al issued on Jan. 8, 1991 discloses a warning/lighting flashlight which includes a front cap which, in turn, can be adjustably rotated around a tube to move the lamp between a first position so as to function as a lighting flashlight and a second position so as to function as a warning flashlight. The present invention is intended to provide an improved design in this regard.

SUMMARY OF THE INVENTION

It is an object of the present invention to provide a flashlight which can be used for illumination, hazard indication, and traffic direction, and which can be used as a desk lamp, lantern, and night-light.

A flashlight in accordance with the present invention comprises a barrel which receives a battery unit therein. A rear cap is mounted to a rear end of the barrel to provide electrical connection between the battery unit and an inner periphery of the barrel. The barrel further includes an outer threading defined in the front end thereof.

The flashlight further includes a lamp assembly including a non-conductive switch seat mounted in the barrel and including a conductive means mounted therein, the conductive means having a first end electrically connected to the battery unit and a second end, a bulb seat securely mounted to the switch seat, a bulb mounted on the bulb seat, an inner conductive element electrically connected between the bulb and the second end of the conductive means, and an outer conductive element electrically connected between the bulb and the inner periphery of the barrel.

A transparent housing has an inner threading defined in an inner periphery thereof so as to be threadedly engaged with the outer threading of the front end of the barrel. The transparent housing further includes an outer threading defined in an outer periphery thereof.

A colored sleeve is removably mounted in the inner threading of the transparent housing. An outer casing is threadedly engaged with the first outer threading, the outer casing being made of a material that light cannot be transmitted. A reflective mirror is mounted in the transparent housing and includes an opening through which the bulb is passable. A front cap is threadedly engaged with the second outer threading to retain the reflective mirror in position to move with the transparent housing.

By such an arrangement, rotational movement of the outer casing causes movements of the outer casing and the reflective mirror relative to the bulb such that the reflective mirror is movable between a first position which is surrounded by the reflective mirror and a second position outside the reflective mirror in which light emitted by the bulb is transmitted outside via the transparent housing. Meanwhile, the colored sleeve is movable between a third position surrounding the bulb in the first position and a fourth position which does not surround the bulb.

In a preferred embodiment of the invention, the inner periphery of the barrel further comprises an annular groove defined therein for securely receiving an end of the outer conductive element, and the switch seat is securely retained between the outer conductive element and the battery unit. Preferably, the switch seat further includes a protrusion projecting outwardly therefrom and extending into the front end of the barrel, and the bulb seat is conductive and mounted to the protrusion while the outer conductive element is mounted between the bulb seat and the switch seat.

The barrel may include a hole defined in the outer periphery thereof, and a retainer ring may be extended through the hole and thus secured to the switch seat, while a button may be securely attached to retainer ring to thereby allow the user to control on/off of the flash light.

Other objects, advantages, and novel features of the invention will become more apparent from the following detailed description when taken in conjunction with the accompanying drawings.

DESCRIPTION OF THE PREFERRED EMBODIMENT

Figure 1:
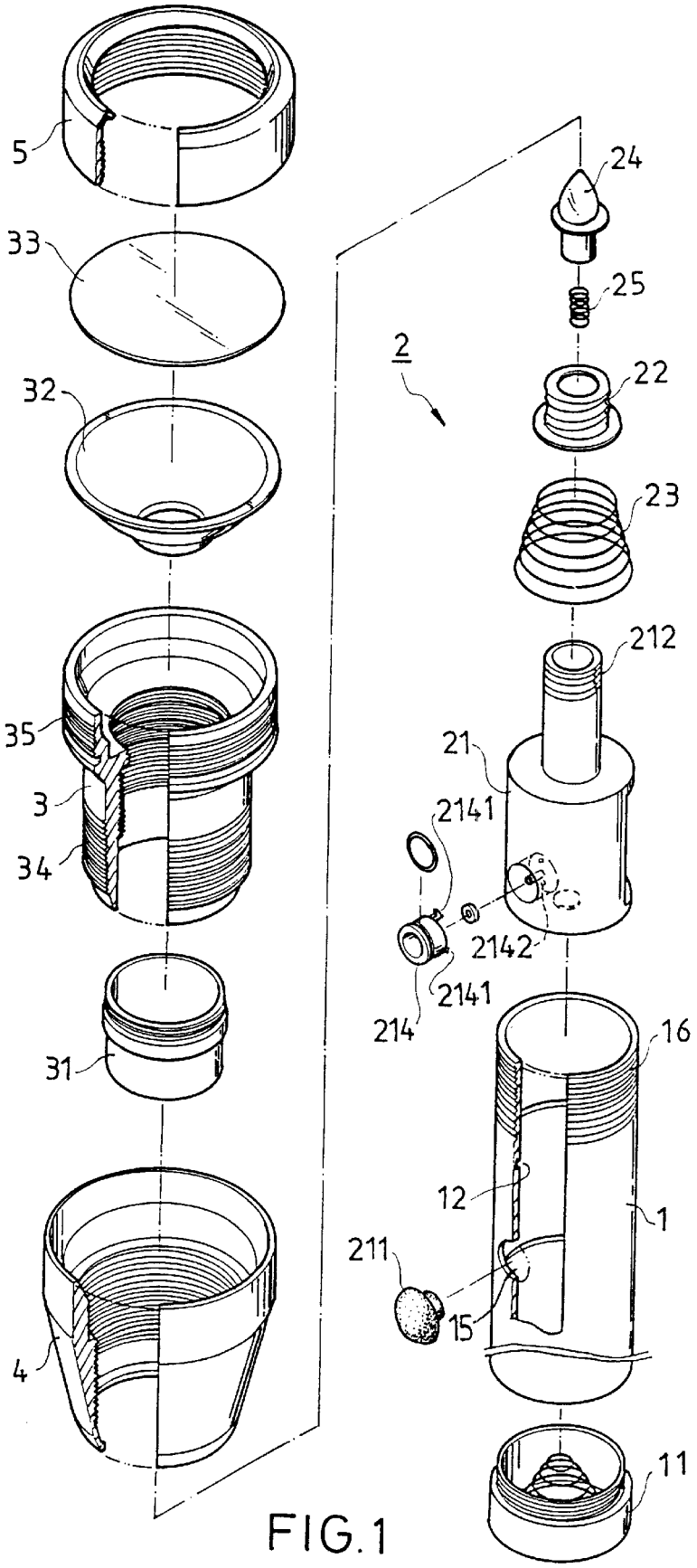
FIG. 1 is an exploded perspective view of a flashlight in accordance with the present invention.
Figure 2:
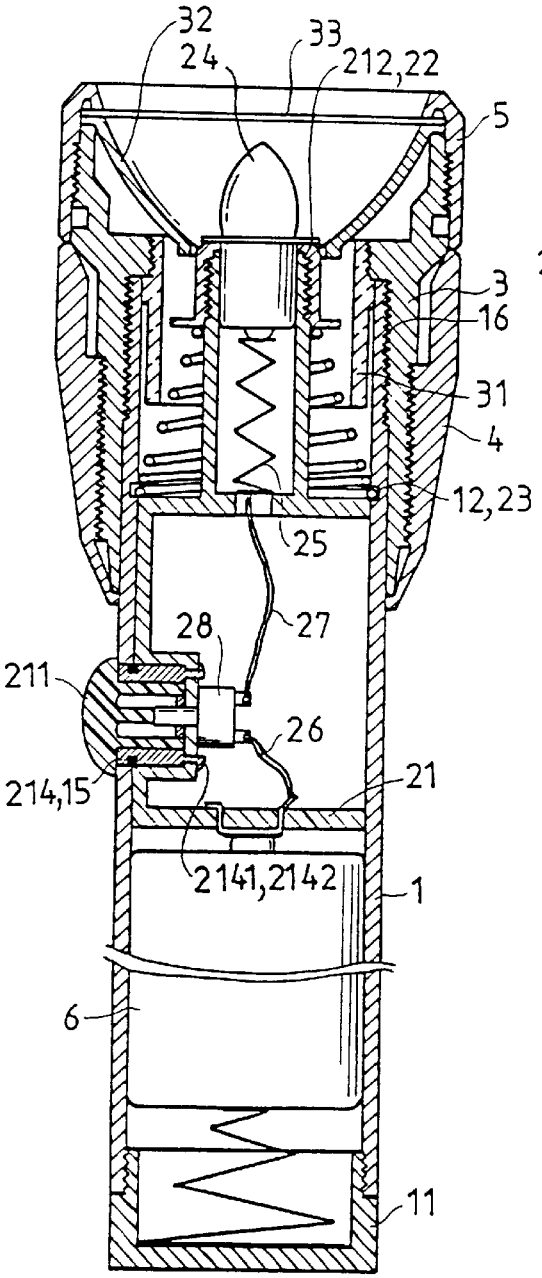
FIG. 2 is a longitudinal sectional view of the flashlight in accordance with the present invention, wherein the flash light is in a status for illumination.

Referring to the drawings and initially to FIGS. 1 and 2, a flashlight in accordance with the present invention generally includes a barrel 1, a lamp assembly 2, a transparent housing 3, an outer casing 4, and a front cap 5. The barrel 1 is preferably cylindrical for housing a battery unit 6 (FIG. 2) therein, and a rear cap 11 is provided to seal a rear end of the barrel 1 and to provide electrical connection between, e.g., a cathode (not labeled) of the battery unit 6 and an inner periphery of the barrel 1, which is conventional and therefore not further described. An annular groove 12 is defined in a front section of the inner periphery of the barrel 1. Further, the barrel 1 includes an outer threading 16 defined in a front section of an outer periphery thereof and a hole 15 defined in the outer periphery thereof at a position behind the annular groove 12.

The lamp assembly 2 includes a non-conductive switch seat 21, a bulb seat 22, an outer conductive element 23, a bulb 24, and an inner conductive element 25. The switch seat 21 is mounted in the barrel 1 between the battery unit 6 and the outer conductive element 23 and includes a number of holes 2142. A retainer ring 214 is extended through the hole 15 and includes a number of legs 2141 extending through the holes 2142 and thus secured to the switch seat 21. A button 211 is securely attached to retainer ring 214 to thereby allow the user to control on/off of the flashlight.

The switch seat 21 further includes a protrusion 212 projecting outwardly therefrom and extending into a front end of the barrel 1. The bulb seat 22 is conductive and mounted to a distal end of the protrusion 212 by threading engagement for mounting the bulb 24, and the outer conductive element 23 (preferably helical) is mounted between the bulb seat 22 and the switch seat 21. In addition, an end of the outer conductive element 23 is securely received in the annular groove 12 of the barrel 1 and thus prevents forward movement of the switch seat 21 toward the bulb 24, i.e., positioning of the end of the outer conductive element 23 in the annular groove 12 may prevent damage of the bulb 24 resulting from forward movement of the switch seat 21. The inner conductive element 25 is received in the projection 212 and has an end electrically connected to the bulb 24, best shown in FIG. 2.

As shown in FIG. 2, the switch seat 21 includes a first wire 26 electrically connected to an anode (not labeled) of the battery unit 6 which is electrically connected to the bulb 24 via the rear cap 11, the inner periphery of the barrel 1, and the outer conductive element 25. The switch seat 21 further includes a second wire 27 electrically connected to the inner conductive element 25 which is electrically connected to the bulb 24, and the first and second wires 26 and 27 are electrically connected via a conductive means 28. Thus, as a closed circuit has been created, the user may control on/off of the bulb 24 by the button 211.

Still referring to FIGS. 1 and 2, the transparent housing 3 is substantially a hollow cylindrical member and made of a material that light can be transmitted. The transparent housing 3 includes an inner threading (not labeled) for engagement with the outer threading 16 on the barrel 1 so as to be mounted around the front end of the barrel 1. The transparent housing 3 further includes a relatively smaller section 34 with an outer threading (not labeled) and a relatively larger section 35 with an outer threading (not labeled). A colored sleeve 31 is threadedly engaged with an inner periphery of the transparent housing 3. The colored sleeve 31 is made of a material that light can be transmitted and is of a desired color, e.g., red, green, etc.

The outer casing 4 is made of non-transparent material that light emitted by the bulb 24 cannot be transmitted. The outer casing 4 includes an inner threading for threadedly engagement with the outer threading on the relatively smaller section 34 of the transparent housing 3. A conic reflective mirror 32 is securely mounted in the relatively larger section of the transparent housing 3 and includes an opening through which the bulb 24 is passable. A lens 33 is mounted in front of the conic reflective mirror 32 to provide a protection. The front cap 5 is threadedly mounted around the relatively larger section 35 of the transparent housing 3 to position the lens 33 and the conic reflective mirror 32.

Figure 3:
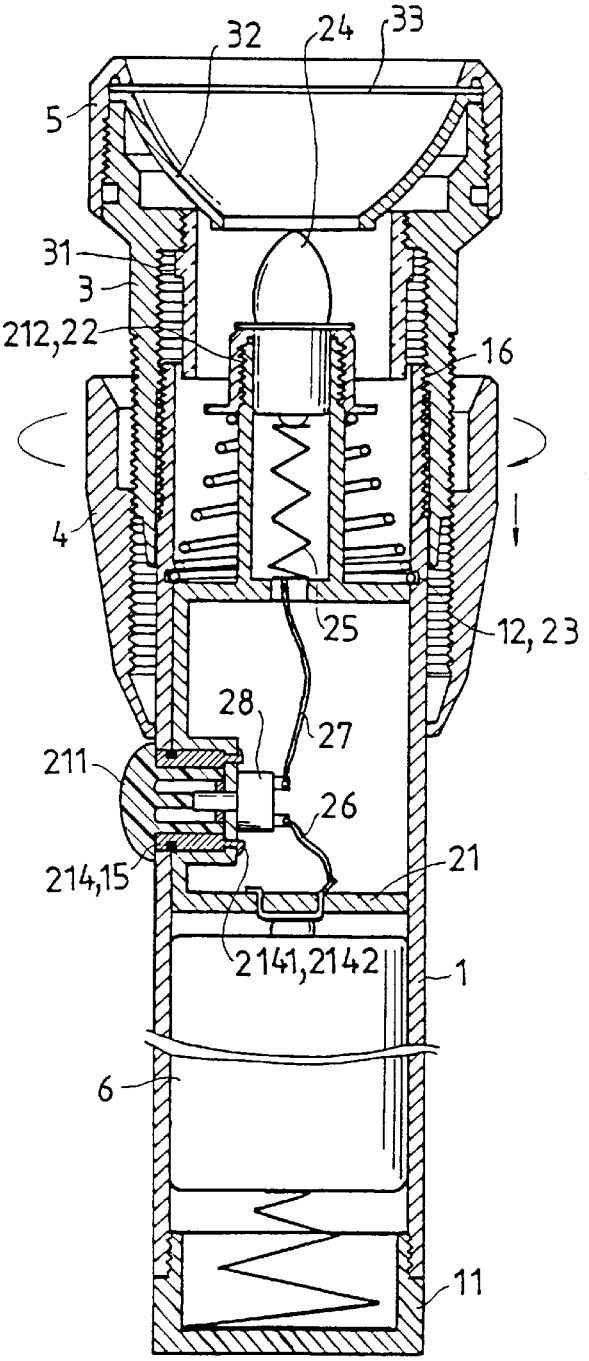
FIG. 3 is a view similar to FIG. 2, wherein the flashlight is in a status for hazard indication.

Now refer to FIGS. 2 and 3. The flashlight in FIG. 2 is in a status for illumination at the forward end as the bulb 24 is surrounded by the reflective mirror 32. It is appreciated that no light from the bulb 24 is transmitted side ways out of the transparent housing 3. The user may rotate the outer casing 4 which causes forward movement of the transparent housing 3 relative to the bulb 24 until the bulb 24 is completely located behind the reflective mirror 32, as shown in FIG. 3, while the outer casing 4 moves rearward toward the button 211. As a result, when the bulb 24 is turned on, the light emitted by the bulb 24 is transmitted sideways out of the colored sleeve 31 and the transparent housing 3. The flashlight now may be used for hazard indication or traffic direction. The flashlight can be changed from the status in FIG. 3 to the status in FIG. 2 upon rotation of the outer casing 4 in a reverse direction.

Figure 4:
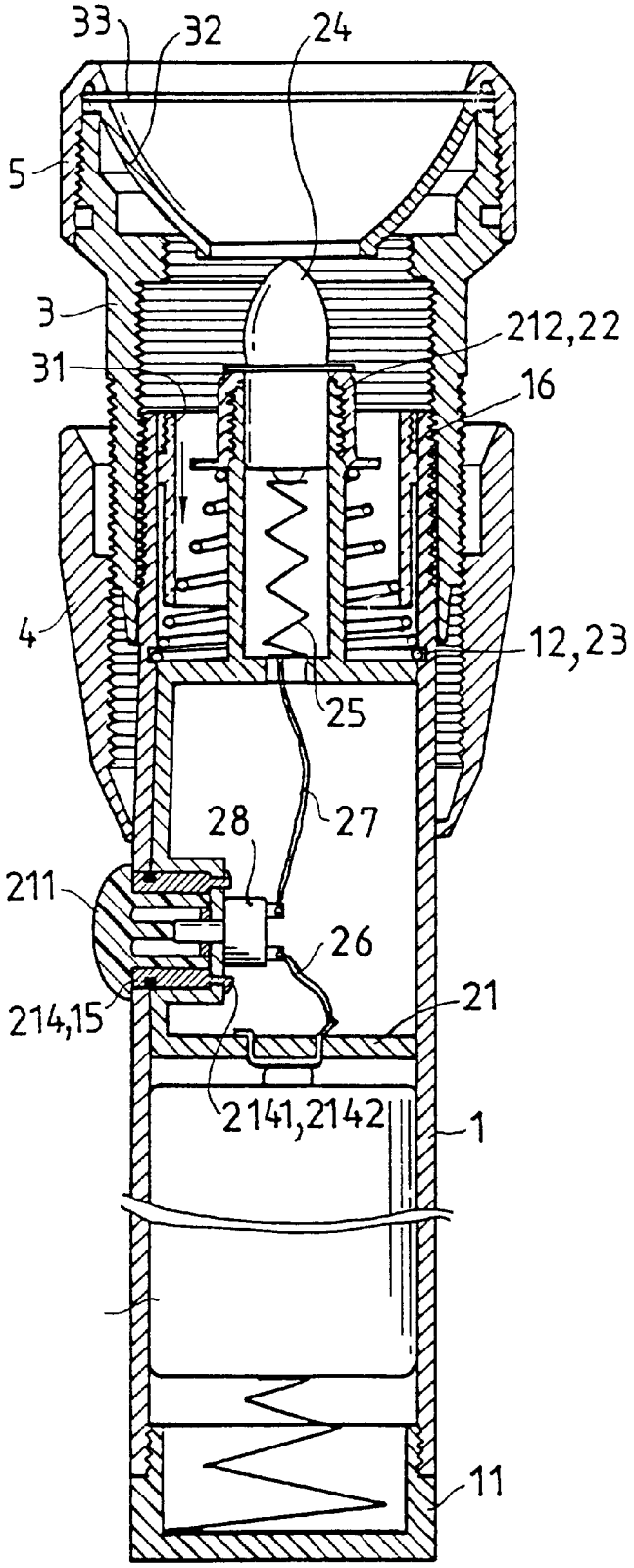
FIG. 4 is a view similar to FIG. 3, wherein the flashlight used as a desk light.

In addition, the user may further change the colored sleeve 31 of the flashlight from a position shown in FIG. 3 to a position in the barrel 1, best shown in FIG. 4. It is achieved by removing the front cap 5, the lens 33, and the reflective mirror 32 and then moving the colored sleeve 31 to the position shown in FIG. 4. Alternatively, the colored sleeve 31 may be removed from the flashlight. After remounting the reflective mirror 32, the lens 33, and the front cap 5, the flashlight can be used as a desk light, lantern, or night light.

Accordingly, the flashlight of the present invention can be used for illumination, hazard indication, and traffic direction, and can be used as a desk lamp, lantern, or night-light.

Although the invention has been explained in relation to its preferred embodiment, it is to be understood that many other possible modifications and variations can be made without departing from the spirit and scope of the invention as hereinafter claimed.

What is claimed is:

1. A flashlight comprising:

a barrel adapted to receive a battery unit therein, the barrel including a front end, a rear end, and an inner periphery, and a rear cap being mounted to the rear end of the barrel to provide electrical connection between the battery unit and the inner periphery of the barrel, the barrel further including an outer threading defined in the front end thereof, a lamp assembly including a non-conductive switch seat mounted in the barrel and including a conductive means mounted therein, the conductive means having a first end electrically connected to the battery unit and a second end, a bulb seat securely mounted to the switch seat, a bulb mounted on the bulb seat, an inner conductive element electrically connected between the bulb and the second end of the conductive means, and an outer conductive element electrically connected between the bulb and the inner periphery of the barrel, a transparent housing having an inner threading defined in the inner periphery thereof so as to be threadedly engaged with the outer threading of the front end of the barrel, the transparent housing further including an outer threading defined in an outer periphery thereof, a colored sleeve removably mounted in the inner threading of the transparent housing, an outer casing threadedly engaged with the first outer threading, the outer casing being made of a material that light cannot be transmitted, a reflective mirror mounted in the transparent housing and including an opening through which the bulb is passable, and a front cap threadedly engaged with the second outer threading to retain the reflective mirror in position to move with the transparent housing, wherein rotational movement of the outer casing causes movements of the outer casing and the reflective mirror relative to the bulb such that the reflective mirror is movable between a first position wherein the bulb is surrounded by the reflective mirror and a second position wherein the bulb is behind the reflective mirror wherein light emitted by the bulb is transmitted sideways out of the transparent housing, and the colored sleeve is movable between a third position surrounding the bulb in the first position and a fourth position which does not surround the bulb.

2. The flashlight according to claim 1, wherein the inner periphery of the barrel further comprises an annular groove defined therein for securely receiving an end of the outer conductive element, and the switch seat is securely retained between the outer conductive element and the battery unit.

3. The flashlight according to claim 1, wherein the barrel further includes a hole defined in the outer periphery thereof, and further comprising a retainer ring which is extended through the hole and thus secured to the switch seat, and a button is securely attached to retainer ring to thereby allow the user to control on/off of the flash light.

4. The flashlight according to claim 2, wherein the switch seat further includes a protrusion projecting outwardly therefrom and extending into the front end of the barrel, and the bulb seat is conductive and mounted to the protrusion while the outer conductive element is mounted between the bulb seat and the switch seat.

* * * * *